US009647377B1

(12) United States Patent
Peng

(10) Patent No.: US 9,647,377 B1
(45) Date of Patent: May 9, 2017

(54) ELECTRICAL CONNECTOR

(71) Applicant: LOTES CO., LTD, Keelung (TW)

(72) Inventor: Zhi Guo Peng, Keeling (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 15/251,326

(22) Filed: Aug. 30, 2016

(30) Foreign Application Priority Data

Jun. 14, 2016 (CN) ..... 2016 2 0564765

(51) Int. Cl.
*H01R 13/504* (2006.01)
*H01R 13/6585* (2011.01)
*H01R 13/405* (2006.01)

(52) U.S. Cl.
CPC ..... *H01R 13/504* (2013.01); *H01R 13/405* (2013.01); *H01R 13/6585* (2013.01)

(58) Field of Classification Search
CPC ..... H01R 13/405; H01R 13/504
See application file for complete search history.

(56) References Cited

U.S. PATENT DOCUMENTS 4,790,776 A * 12/1988 Iijima ..... H01R 24/28 439/695
2014/0073182 A1* 3/2014 Ardisana, II ..... B29C 45/14065 439/607.01
2015/0244111 A1* 8/2015 Ju ..... H01R 13/6585 439/607.05
2015/0244118 A1* 8/2015 Lin ..... H01R 24/60 439/357
2016/0240980 A1* 8/2016 Yu ..... H01R 13/6581
2016/0285209 A1* 9/2016 Peng ..... H01R 13/6585
2016/0315423 A1* 10/2016 Yao ..... H01R 24/62
2016/0352041 A1* 12/2016 Yao ..... H01R 13/516
2016/0359256 A1* 12/2016 Zhang ..... H01R 13/405
2016/0380388 A1* 12/2016 Guo ..... H01R 13/6581 439/83

* cited by examiner

*Primary Examiner* — James Harvey
(74) *Attorney, Agent, or Firm* — Locke Lord LLP; Tim Tingkang Xia, Esq.

(57) ABSTRACT

An electrical connector includes multiple terminals and an insulation body integrally formed with the terminals. Each terminal has a contacting portion and a head portion extending forward from the contacting portion. The insulation body includes a tongue extending along a front-back direction. Each contacting portion is partially insert-molded to the tongue and partially exposed to a surface of the tongue. Each head portion is embedded into a front end of the tongue. The insulation body has a first gate and a second gate. The first gate is located on a front end surface of the tongue, and the second gate is located in a middle portion or a rear portion of the insulation body.

13 Claims, 5 Drawing Sheets

ELECTRICAL CONNECTOR

CROSS-REFERENCE TO RELATED APPLICATIONS

This non-provisional application claims priority to and benefit of, under 35 U.S.C. §119(a), Patent Application No. 201620564765.2 filed in P.R. China on Jun. 14, 2016, the entire content of which is hereby incorporated by reference.

FIELD OF THE INVENTION

The present invention relates generally to an electrical connector, and more particularly to an electrical connector of an input/output type.

BACKGROUND OF THE INVENTION

The background description provided herein is for the purpose of generally presenting the context of the present invention and is neither expressly nor impliedly admitted as prior art against the present invention. The subject matter discussed in the background of the invention section should not be assumed to be prior art merely as a result of its mention in the background of the invention section. Similarly, a problem mentioned in the background of the invention section or associated with the subject matter of the background of the invention section should not be assumed to have been previously recognized in the prior art. The subject matter in the background of the invention section merely represents different approaches, which in and of themselves may also be inventions.

An existing electrical connector includes an insulation body made of a plastic material, and multiple terminals inserted into the insulation body. The insulation body includes a base and a tongue extending forward from the base. Each of the terminals has a contacting portion partially embedded in the tongue and partially exposed to a surface of the tongue. A head portion of the terminal is located in front of the contacting portion, and the head portion is embedded in the tongue to prevent the head portion of the terminal from tilting. During molding of such an electrical connector, plastics generally feed in a rear end of the insulation body, so as to form point gates at the base. As plastics flow into a die cavity from the rear end in a molten state, the plastics are not easy to flow to the front end or only a small quantity thereof flows to the front end, resulting in that it is difficult to mold the front end of the tongue or the front end of the tongue formed is relatively thin, and thus the plastics in the front end of the tongue covering the head portions of the terminals are very thin, and bonding of the terminals and the plastics is instable, resulting in that the head portions are easy to tilt, which affects electrical transmission functions of the electrical connector.

Therefore, a heretofore unaddressed need exists in the art to address the aforementioned deficiencies and inadequacies.

SUMMARY OF THE INVENTION

In one aspect, the present invention relates to an electrical connector which can ensure good bonding of head portions of terminals and plastics and prevent the head portions from tilting.

In certain embodiments, an electrical connector includes multiple terminals and an insulation body integrally formed with the terminals. Each of the terminals has a contacting portion and a head portion extending forward from the contacting portion. The insulation body includes a tongue extending along a front-back direction. The contacting portions are partially insert-molded in the tongue and partially exposed from a surface of the tongue, and the head portions are embedded into a front end of the tongue. The insulation body has a first gate and a second gate, the first gate is located on a front end surface of the tongue, and the second gate is located in a middle portion or a rear portion of the insulation body.

In certain embodiments, the first gate is located in a center position of the front end surface of the tongue. The first gate is a circular or oval dent.

In certain embodiments, the electrical connector further includes an insulating seat and an insulator. The terminals are insert-molded into the insulator to form a terminal module, and the terminal module is insert-molded into the insulating seat. The insulating seat includes a body portion and a sheet portion extending forward from the body portion. The contacting portions are insert-molded into a front segment of the sheet portion, and the head portions extend out of a front end of the sheet portion. The insulating seat includes a base and a plate portion extending forward from the base. The base is located in front of the front portion and is bonded to a rear segment of the sheet portion, and the plate portion is frame-like and bonded to the front segment of the sheet portion to form the tongue. The insulating seat further includes a step portion connecting the base and the plate portion. The step portion wraps a middle segment of the sheet portion; both the width and the thickness of the step portion are less than those of the base. The thickness of the tongue is less than that of the step portion. The second gate is located at the step portion. In one embodiment, the second gage is located at the step portion.

In certain embodiments, the electrical connector further includes a middle shielding sheet. The multiple terminals are divided into an upper row of terminals and a lower row of terminals. The two rows of terminals are respectively insert-molded into an insulator to form two terminal modules, and the two terminal modules clamp the middle shielding sheet and are integrally insert-molded into the insulating seat. The middle shielding sheet is provided with a through hole, and upper and lower surfaces of the tongue are in communication in the through hole. The contacting portions are plate-like, and the head portions bend from the contacting portion towards the interior of the tongue.

In certain embodiments, the first gate is located on a central axis of the tongue along a front-back direction.

In certain embodiments, the insulation body has a width direction perpendicular to the front-back direction, and the second gate is located in a center position of the insulation body along the width direction.

In certain embodiments, the multiple terminals include two pairs of high-speed differential signal terminals, and the first gate and the second gate are away from the high-speed differential signal terminals.

Compared with the related art, in In certain embodiments of the present invention, a first gate is added on a front end surface of the tongue, to enable plastics to indeed flow to front end positions of the tongue, molding is reliable, and at the same time, the plastics indeed wrap the head portions of the terminals, which ensures that the terminals are stably bonded to the plastics, ensures that the head portions of the terminals are embedded into the front end of the tongue, prevents the head portions of the terminals from tilting, and ensures reliable electrical contact of the terminals and even electrical transmission functions of the electrical connector.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment.

DETAILED DESCRIPTION OF THE INVENTION

Figure 1:
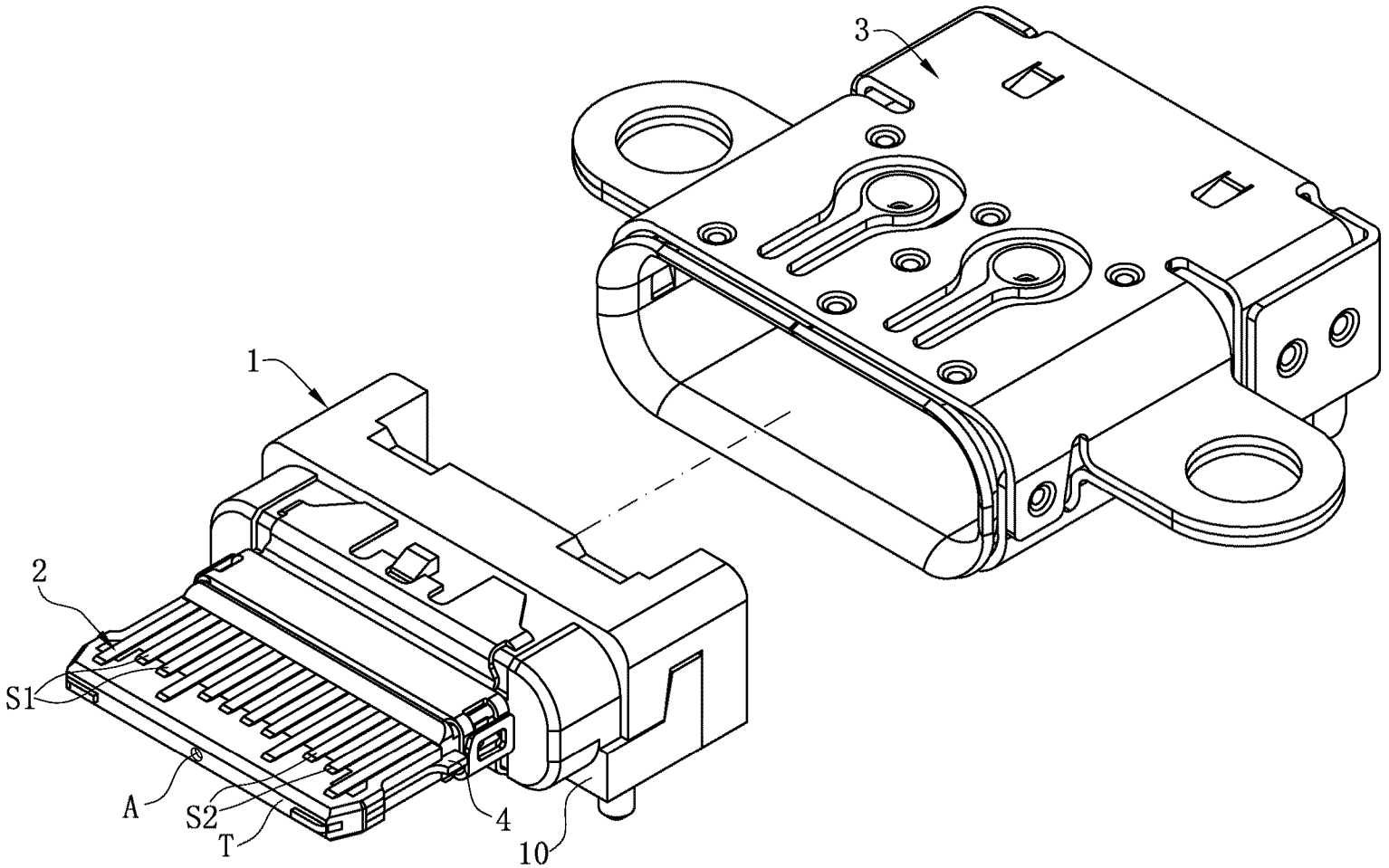
FIG. 1 is a schematic view of an electrical connector according to one embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-5. In accordance with the purposes of this invention, as embodied and broadly described herein, this invention, in one aspect, relates to an electrical connector.

As shown in FIG. 1, an electrical connector according to one embodiment of the present invention includes an insulation body 1, the insulation body 1 is internally disposed with multiple terminals 2, and the insulation body 1 is externally sleeved with a metal shell 3.

Figure 2:
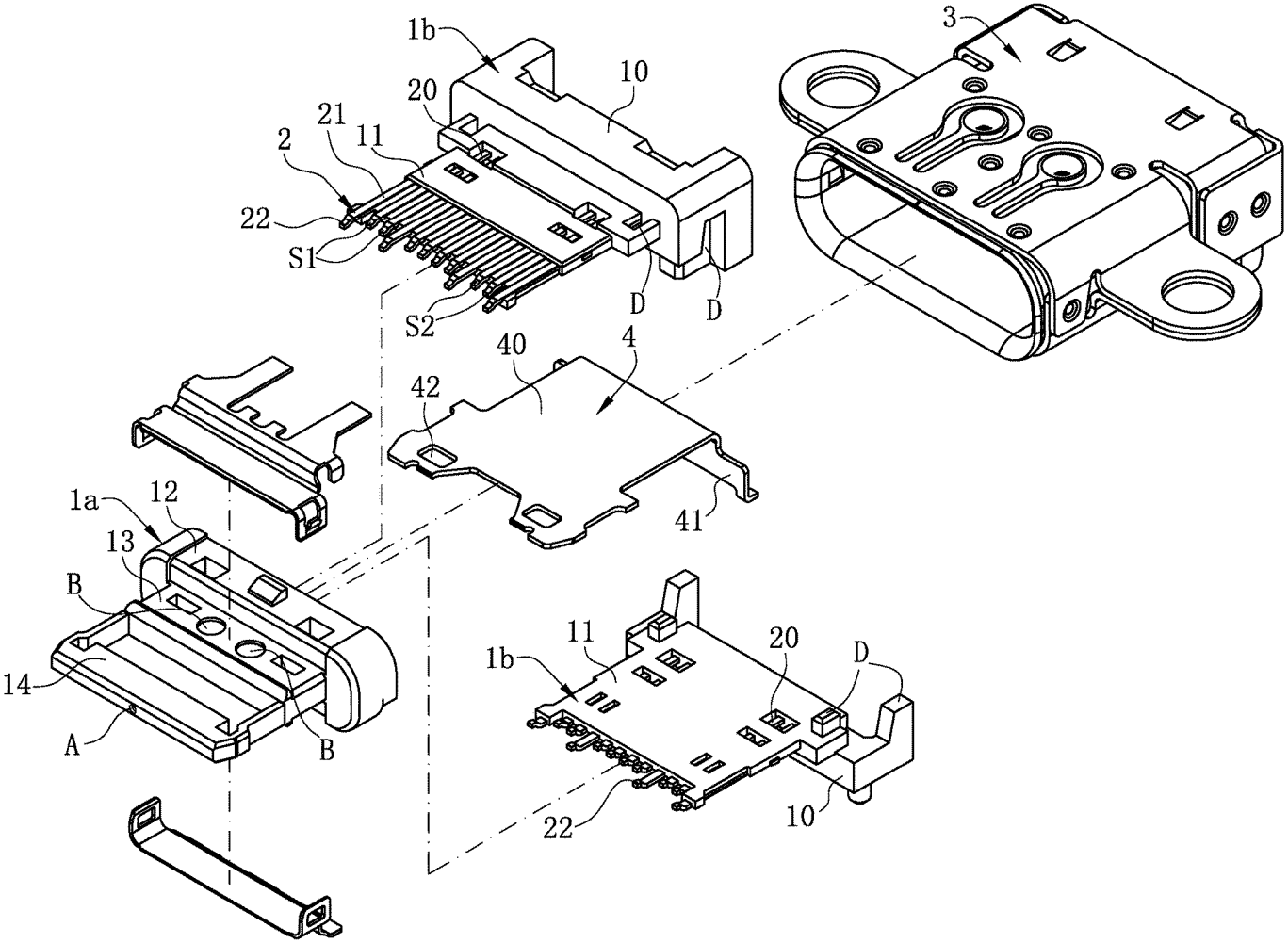
FIG. 2 is an exploded view of FIG. 1.
Figure 3:
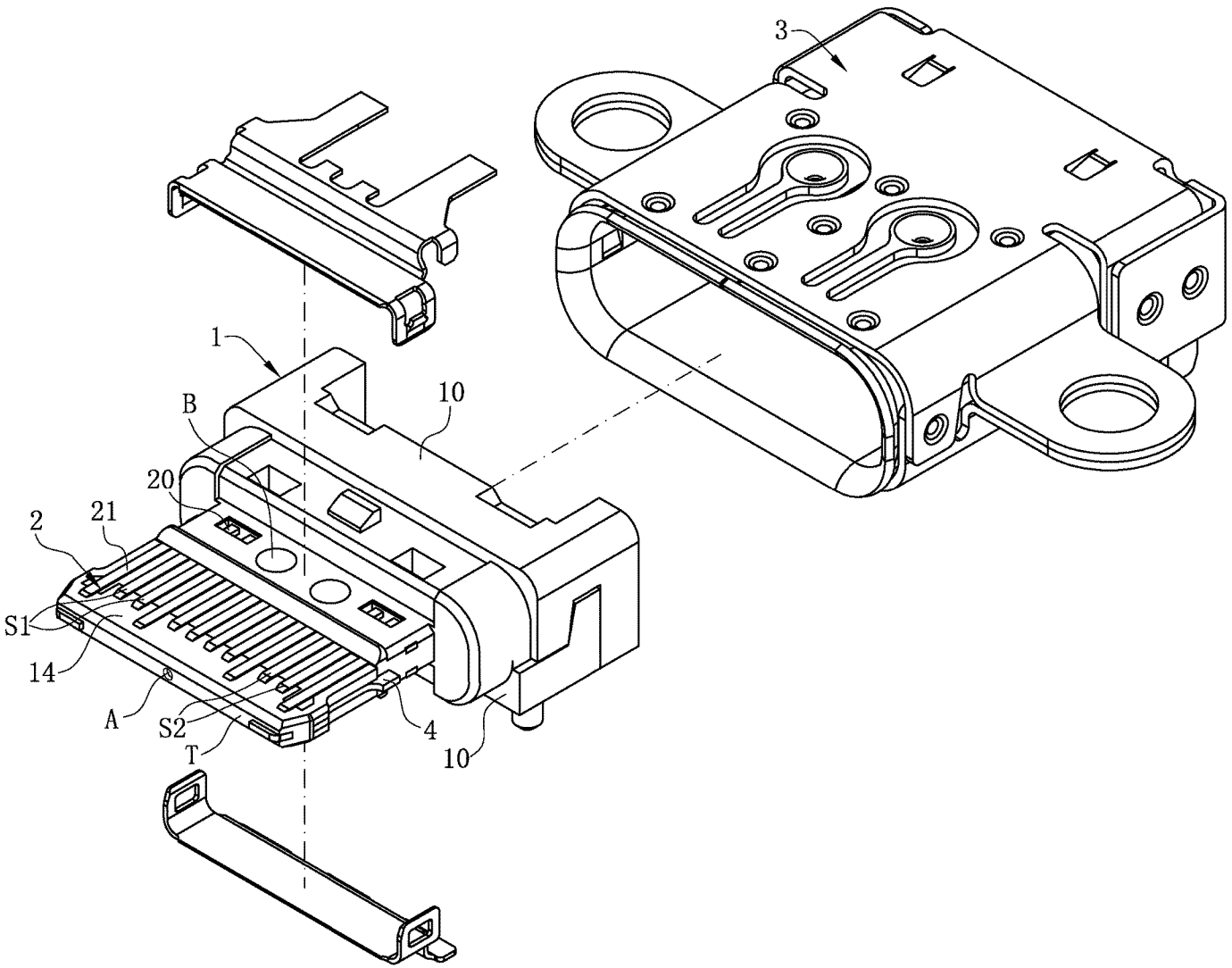
FIG. 3 is a schematic view of bonding the terminal module and the insulating seat in FIG. 2.
Figure 5:
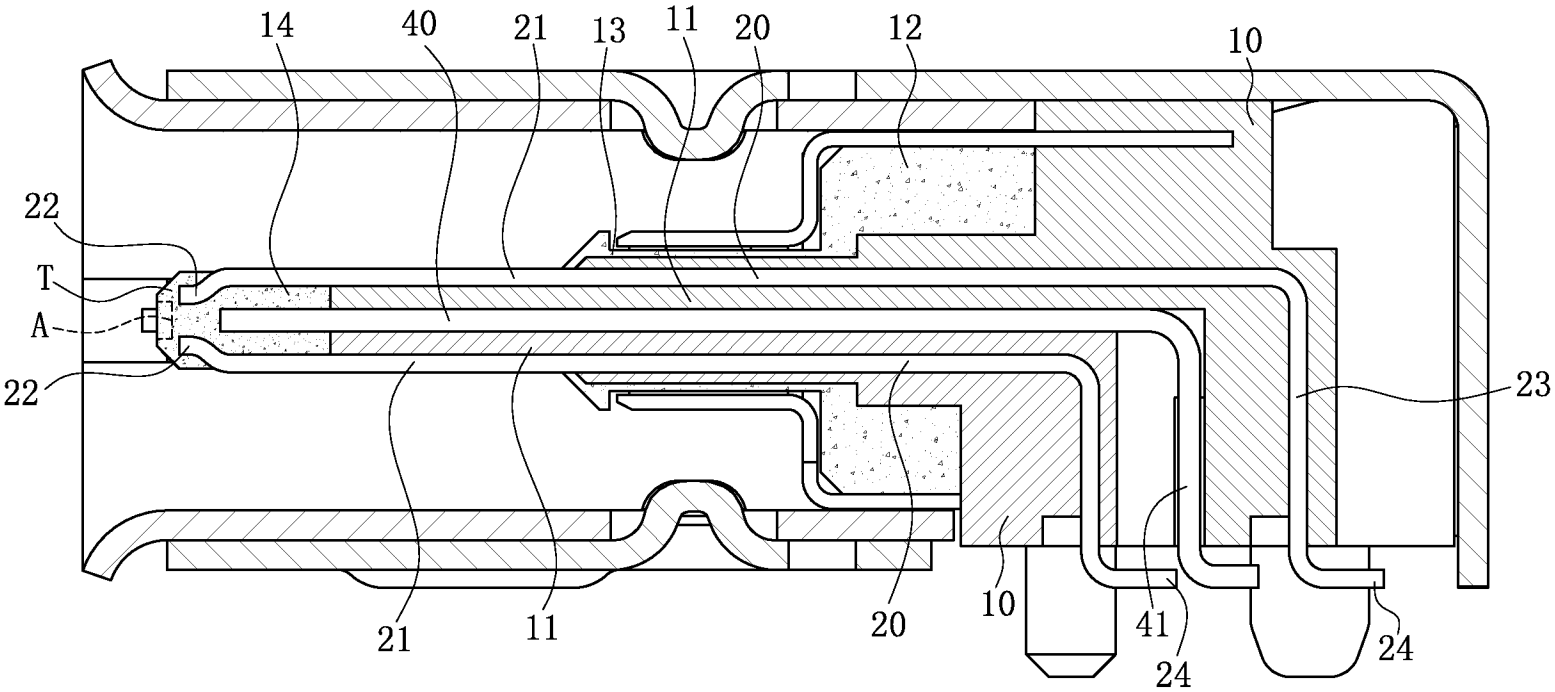
FIG. 5 is an overall sectional view of an electrical connector according to one embodiment of the present invention.

In certain embodiments, the electrical connector is a USB C TYPE receptacle connector. The terminals 2 are divided into an upper row of terminals and a lower row of terminals, and the two rows of terminals 2 are arranged in central symmetry, suitable for achieving insertion in dual orientation. As shown in FIGS. 2 and 5, the terminals 2 are made to be long and thin from sheet metal. Each of the terminals 2 includes a retaining portion 20 extending horizontally along a front-back direction. The retaining portion 20 extends forward to form a plate-like contacting portion 21, and the contacting portion 21 is used for contacting elements in a mating plug (not shown). The contacting portion 21 extends forward and bends to form a head portion 22. The head portions 22 of the upper and lower rows of terminals 2 bend toward each other. The head portion 22 is a front end (free end) of the whole terminal 2. The retaining portion 22 bends backward and downward to form a connecting portion 23, and the connecting portion 23 bends and extends backward to form a surface mount soldering (SMT)-type soldering portion 24, for being soldered to a circuit board (not shown). The multiple terminals 2 include two pairs of high-speed differential signal terminals S1 and S2.

As shown in FIGS. 1, 2 and 5, the insulation body 1 is inject-molded from plastics, and has a first gate A and one or more second gates B. The first gate A is located on a front end surface of the whole insulation body 1, and the second gate B is located in a middle portion or a rear portion of the insulation body 1. The insulation body 1 includes an insulating seat 1*a* and two insulators 1*b*. Each insulator 1*b* is integrally insert-molded with a row of the terminals 2 to form a terminal module. The two terminal modules are arranged up and down, and are assembled together through a buckle structure D of the two insulators 1*b*. Finally the terminal modules are insert-molded in the insulating seat 1*a*.

As shown in FIGS. 2 and 5, specifically, each of the insulators 1*b* includes a body portion 10 and a sheet portion 11 extending forward from the body portion 10. Each of the retaining portions 20 is insert-molded in the body portion 10, and extends to be insert-molded into a middle-rear segment of the sheet portion 11. The connecting portion 23 is integrally insert-molded into the body portion 10. The soldering portion 24 extends out of a lower side of the body portion 10. The contacting portion 21 is insert-molded into a front segment of the sheet portion 11. The head portion 22 protrudes beyond the front segment of the sheet portion 11.

A middle shielding sheet 4 is further sandwiched between two insulators 1*b*. The two terminal modules clamp the middle shielding sheet 4 and are integrally insert-molded into the insulating seat 1*a*. The middle shielding sheet 4 is located between the upper and lower rows of terminals 2.

The middle shielding sheet 4 includes a horizontal plate 40 located between upper and lower rows of contacting portions 21 and retaining portions 20, and a vertical plate 41 located between upper and lower rows of connecting portions 23. The horizontal plate 40 is provided with one or more through holes 42. The vertical plate 41 extends downward to form a SMT-type soldering leg. The middle shielding sheet 4 is used for shielding crosstalk interference between the upper and lower rows of terminals 2.

The insulating seat 1*a* is integrally wrapped outside the two terminal modules. The insulating seat 1*a* includes a base 12 and a step portion 13 extending forward from the base 12, and the step portion 13 extends forward to form a plate portion 14. Both the width and the thickness of the step portion 13 are less than those of the base 12. The base 12 is in front of the body portion 10 and wraps a rear segment of the sheet portion 11. The step portion 13 wraps a middle segment of the sheet portion 11. The plate portion 14 is frame-like and bonded to the front segment of the sheet portion 11 to form a tongue T. The thickness of the tongue T is less than that of the step portion 13. Two pairs of high-speed differential signal terminals S1 and S2 are arranged on two sides of a central axis of the tongue T along the front-back direction, and away from the central axis.

As shown in FIGS. 2-5, contacting portion 21 of each of the terminals 2 is partially insert-molded into the tongue T and partially exposed to a surface of the tongue T. The head portion 22 is embedded into a front end of the tongue T. Two sides of the horizontal plate 40 of the middle shielding sheet 4 protrude beyond two sides of the tongue T. Upper and lower surfaces of the tongue T are in communication in the through hole 42 of the middle shielding sheet 4, which can enhance strength of the tongue T.

Figure 4:
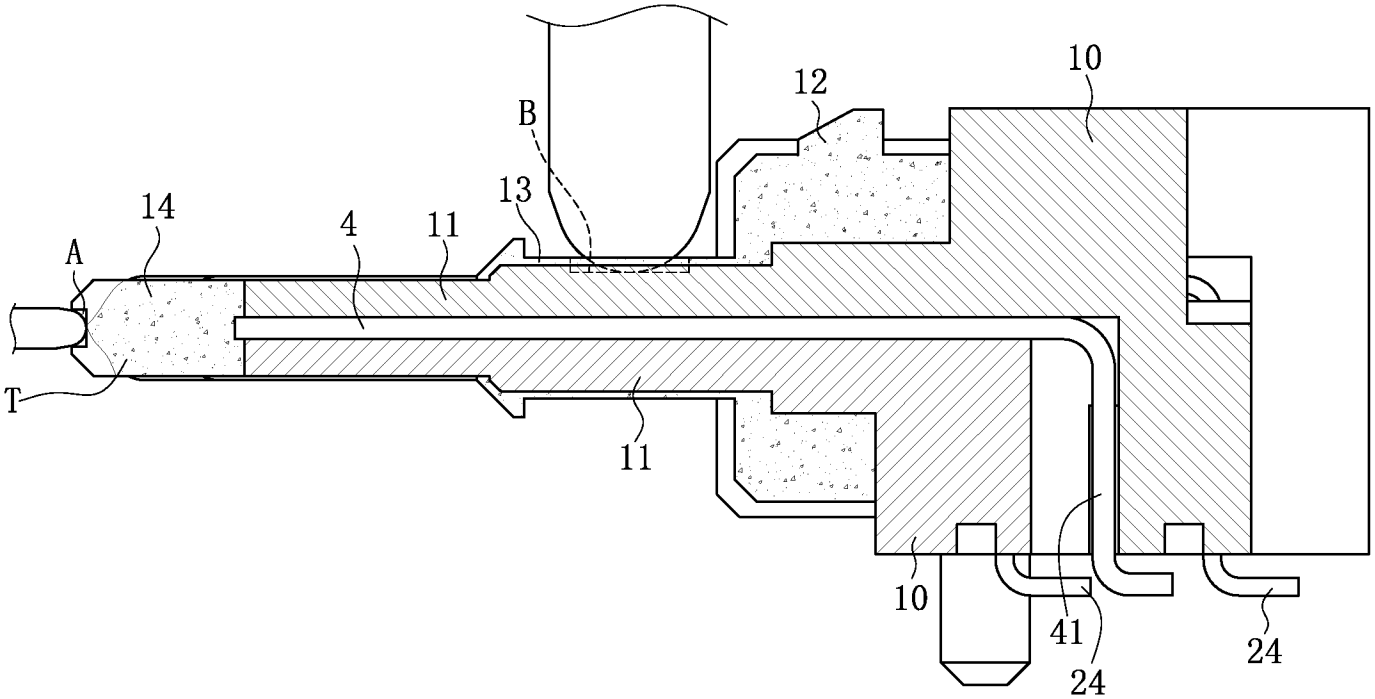
FIG. 4 is a schematic view of the insulating seat in FIG. 3 during molding.

As shown in FIG. 4, in one embodiment of the present invention, to fix the head portions 22 of the terminals 2, prevent the head portions 22 of the terminals 2 from tilting and facilitate molding, plastics are poured respectively in a front end and a middle portion of the terminal module. Plastics poured in two plastic-pouring positions are finally bonded into a whole, to form the insulating seat 1*a*, and the insulating seat 1*a* is also bonded into a whole with the two insulators 1*b*. A first gate A is located on a front end surface of the tongue T, and the first gate A is located on a central axis of the tongue T along the front-back direction and located in a central position on the front end surface of the tongue T, which can ensure flowing directions and flowing speeds of the plastics poured in are uniform and thicknesses of the formed structures are also identical. The first gate A is specifically a circular or oval dent. Two second gates B are located on an upper surface of the step portion 13. The first gate A and the second gates B are away from the high-speed differential signal terminals S1 and S2, which can reduce influences of the first gate A and the second gates B on the high-speed differential signal terminals S1 and S2's transmitting high-frequency signals.

In certain embodiments, it is also feasible to dispose two or three first gates A in the front end, and the first gates A are symmetrically arranged from the center to two sides on the front end surface of the tongue T. In certain embodiments, the insulation body 1 has a width direction perpendicular to the front-back direction, and the second gate B is located in a center position of the insulation body 1 along the width direction.

As shown in FIG. 4, the electrical connector according to certain embodiments of the present invention is substantially molded as follows: at first, upper and lower rows of terminals 2 are respectively insert-molded into an insulator 1*b* to form upper and lower terminal modules; then a middle shielding sheet 4 is sandwiched between the upper and lower terminal modules; the two terminal modules are snap-fit together; a second insert molding process is carried out, and plastics are poured corresponding to positions of the first gate A and the second gate B respectively in front ends and middle portions of the terminal modules, to form an insulating seat 1*a* wrapping the two terminal modules and the middle shielding sheet 4.

Compared with related art, certain embodiments of the present invention, among other things, have the following beneficial advantages:

1. A first gate A is added to a front end surface of the tongue T, and a second gate B is located in a middle portion or a rear portion of the insulation body 1. Combining the use of the first gate A and the second gate B, plastics can indeed flow to front end positions of the tongue T, and molding is reliable. At the same time, the plastics indeed wrap the head portions 22 of the terminals 2, which ensures that the terminals 2 are stably bonded to the plastics, ensures that the head portions 22 of the terminals 2 are embedded into the front end of the tongue T, prevents the head portions 22 of the terminals 2 from tilting, and ensures reliable electrical contact of the terminals 2 and even electrical transmission functions of the electrical connector.

2. The first gate A is located in a center position of the front end surface of the tongue T, which can ensure that flowing directions and flowing speeds of the plastics poured in are uniform, and the formed structures of the tongue T has an even thicknesses.

3. As the insulator 1*b* extends to form the sheet portion 11 wrapping the contacting portions 21 of terminals 2. When plastics are poured in from the first gate A in the front end, only a small quantity of plastics is needed to bond the front segment of the sheet portion 11 to form the tongue T. That is to say, the plate portion 14 is thinner, there are fewer plastics, and requirements for flowing speeds and pressure of the plastics during plastics-pouring are reduced, which facilitates molding.

4. The middle shielding sheet 4 plays a role of shielding crosstalk between the upper and lower terminals 2, the upper and lower surfaces of the tongue T are in communication in the through hole 42 of the middle shielding sheet 4, and strength of the tongue T may also be enhanced, to prevent the tongue T from fracturing under improper or excessive force.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, comprising:

a plurality of terminals, each having a contacting portion and a head portion extending forward from the contacting portion; and an insulation body integrally formed with the terminals, and comprising a tongue extending along a front-back direction thereof, wherein the contacting portion of each of the terminals is partially insert-molded in the tongue and partially exposed from a surface of the tongue, and the head portion of each of the terminals is embedded into a front end of the tongue, wherein the insulation body comprises a first gate and a second gate, the first gate is located on a surface of the front end of the tongue, and the second gate is located in a middle portion or a rear portion of the insulation body.

2. The electrical connector of claim 1, wherein the first gate is located in a center position of the front end surface of the tongue.

3. The electrical connector of claim 1, wherein the first gate is a circular or oval dent.

4. The electrical connector of claim 1, wherein the electrical connector further comprises an insulating seat and an insulator, and the terminals are insert-molded into the insulator to form a terminal module, and the terminal module is insert-molded into the insulating seat.

5. The electrical connector of claim 4, wherein the insulator comprises a body portion and a sheet portion extending forward from the body portion, the contacting portions are insert-molded into a front segment of the sheet portion, and the head portions extend out of a front end of the sheet portion; and the insulating seat comprises a base and a plate portion extending forward from the base, the base is located in front of the body portion and is bonded to a rear segment of the sheet portion, and the plate portion is frame-like and bonded to the front segment of the sheet portion to form the tongue.

6. The electrical connector of claim 5, wherein the insulating seat further comprises a step portion connecting the base and the plate portion, the step portion wraps a middle segment of the sheet portion, both a width and a thickness of the step portion are less than those of the base, and a thickness of the tongue is less than that of the step portion.

7. The electrical connector of claim 6, wherein the second gate is located at the step portion.

8. The electrical connector of claim 4, further comprising a middle shielding sheet, the plurality of terminals are divided into an upper row of terminals and a lower row of terminals, the two rows of terminals are respectively insert-molded into the insulator to form two terminal modules, and the two terminal modules clamp the middle shielding sheet and are integrally insert-molded into the insulating seat.

9. The electrical connector of claim 8, wherein the middle shielding sheet comprises a through hole, and upper and lower surfaces of the tongue are in communication in the through hole.

10. The electrical connector of claim 1, wherein the contacting portion is plate-like, and the head portion bends from the contacting portion toward the interior of the tongue.

11. The electrical connector of claim 1, wherein the first gate is located on a central axis of the tongue along a front-back direction.

12. The electrical connector of claim 1, wherein the insulation body has a width direction perpendicular to the front-back direction, and the second gate is located in a center position of the insulation body along the width direction.

13. The electrical connector of claim 1, wherein the plurality of terminals comprises two pairs of high-speed differential signal terminals, and the first gate and the second gate are away from the high-speed differential signal terminals.

* * * * *